United States Patent [19]

Mansolill et al.

[11] 4,241,688

[45] Dec. 30, 1980

[54] EXERCISING DEVICE FOR WATER USE

[76] Inventors: Ralph A. Mansolill; Kathryn R. Mansolill, both of 1933 North Conference Dr., Boca Raton, Fla. 33452

[21] Appl. No.: 972,016

[22] Filed: Dec. 21, 1978

[51] Int. Cl.[3] ..... B63B 35/72

[52] U.S. Cl. ..... 440/26; 9/347; 272/1 B; 440/90

[58] Field of Search ..... 272/1 B, 73, 130, 71, 272/114; 9/301, 310 J, 311, 400, 347, 348; 115/2, 21, 23, 25, 26.3, 22.3, 19, 49; 280/205; D21/236, 237; 5/449, 455, 456

[56] References Cited

U.S. PATENT DOCUMENTS

| | | | |
|---|---|---|---|
| D. 116,359 | 8/1939 | Banks et al. | D21/237 |
| 6,581 | 7/1849 | Seely | 5/456 X |
| 1,610,778 | 12/1926 | Helm | 9/347 X |
| 2,169,391 | 8/1939 | Nilsson | 115/19 |
| 2,317,905 | 4/1943 | Galkin | 115/26.3 |
| 2,542,143 | 2/1951 | Jones | 115/25 |
| 3,120,833 | 2/1964 | Curelich | 115/25 |
| 3,528,116 | 9/1970 | Fenar | 272/1 B UX |

FOREIGN PATENT DOCUMENTS

| | | | |
|---|---|---|---|
| 2606456 | 8/1977 | Fed. Rep. of Germany | 115/26.3 |
| 1041566 | 6/1953 | France | 9/347 |
| 609298 | 9/1960 | Italy | 115/26.3 |
| 164789 | 1/1934 | Switzerland | 5/456 |
| 110686 | 11/1917 | United Kingdom | 5/455 |

*Primary Examiner*—Richard C. Pinkham
*Assistant Examiner*—Arnold W. Kramer
*Attorney, Agent, or Firm*—Barry L. Haley; Eugene F. Malin; Philip R. Wadsworth

[57] ABSTRACT

A device useful for exercising in a swimming pool or other body of water which allows the person to be supported in a substantially seated upright position in the body of water such that the neck, head and upper shoulders of the person remain out of the water, allowing the person to exercise the legs, arms and torso while neutrally buoyant. The device is constructed of a buoyant body that is contoured to be stable and recessed laterally to be comfortably straddled by a person exercising, and includes a smaller forward portion and a larger (in volume) rear portion upon which the person is seated while in the water. The particular shape of the device is such that the center of buoyancy of the body is positioned to substantially be disposed forward of the vertical spine (near the center of gravity) of the user for balance and stability in the water. The user, may thus sit upon the body and freely move his legs and arms for exercise in a seated, upright position.

In an alternate embodiment, a water paddling device, which is engagable with the feet of the user, may be suspended vertically below the buoyant body for more stringent leg exercise and may be used for transportation about the body of water, or to create a whirlpool effect around the body of the user.

1 Claim, 5 Drawing Figures

EXERCISING DEVICE FOR WATER USE

BACKGROUND OF THE INVENTION

This invention relates generally to a personal exercising, athletic, or recreational device that is used in a body of water, such as a swimming pool, lake, or the like, that allows one to exercise in a seated, upright position while partially submerged in the water. The device allows for free movement of the legs, arms, and torso while at the same time providing a buoyant, stable, sitting platform to allow the user to remain in a comfortable, upright position with his head and upper torso portion out of the water.

In the prior art, there are shown various devices which have been used for transportation in the water motivated by the leg propulsion of an individual. These devices employed elaborate floatation members. Using these devices, the person was either submerged almost completely under water or was suspended above the water. Other forms of recreational devices are known which float on the surface such as rubber rafts, upon which the person lies in a swimming position, for kicking or movement of the hands. Oftentimes, this results in the user becoming submerged or splashed or may even result in falling off of the platform. While swimming per se without floatation aids is a good exercise and is often desirable, many people do not wish to become completely submerged (especially face and hair) while exercising in a pool or lake or the like. Another deficiency of the prior art devices is that they are not easily mounted or dismounted by persons with physical impediments such as arthritis, who could otherwise benefit from therapeutic exercise in water.

The present invention allows a person to comfortably and safely exercise in a swimming pool in an upright position to achieve exercising of the legs, arms, or torso while still preventing the entire body of the person from becoming completely submerged.

BRIEF DESCRIPTION OF THE INVENTION

A device which is utilized for buoyantly supporting a person in a seated, upright position in a body of water such as a swimming pool, while permitting relatively free movement of the legs, arms, and torso in a treading water type of swimming motion comprising a specially shaped buoyant body, the body having a relatively enlarged rear volume portion, a central laterally recessed area on both said sides and a forward relatively smaller volume portion. In one embodiment, the body is an inflatable bladder including an inflation valve which allows it to receive or release air disposed therein so that the volume of air is adjustable to establish a particular buoyancy force necessary to support any sized person in a stable buoyant position within the water, depending upon the volume displaced by the person and the weight of the person.

The overall shape of the buoyant body includes a narrowed tapered lateral middle portion, a smaller diverging front end portion and an enlarged (in volume) rear portion. The volume of the rear portion with respect to and relative to the forward portion is such that the center of buoyancy of the device is located approximately three-quarters of the distance from the forward end point of the body. The center of buoyancy is positioned to align vertically with the center of gravity of a person mounted on the seat in the exercising position. The lateral diameter is large enough to permit free movement of the arms and torso of the person mounted thereupon without upsetting the stability of the body. The shape and size of the device allows for effortless and safe mounting and dismounting in the water.

It is desirable for the person mounted on the device to achieve positive or at least neutral stability. The shape and volume of the present invention are such that the buttocks of the user are supported on the enlarged rear portion which contains the larger volume of air relative to the forward portion. This is necessary for achieving the proper alignment with respect to the center of buoyancy of the device and the center of gravity of the user. At the same time, the recessed lateral central portion of the device, when a person is mounted thereupon, is such that the legs of the user can be freely moved in a paddle-like or bicycling-like motion without being restrained or interfered by any surface area of the device and without changing the stability of the buoyant body.

For additional balance, the forward end of the buoyant body may include a grasping handle which allows the user to hold on to the seat while in use.

The hollow, inflatable body includes an air valve which allows it to be blown up or deflated by the user to achieve the proper volume of air to adjust to the weight and volume of displacement of the user to achieve a positive stability such that the user both as to his head, neck and upper shoulder areas may be suspended above the water while the remainder of the torso and lower body is disposed within the water.

The body itself may be constructed of any desirable thermal plastic material that is resilient and provides an airtight sealed chamber.

In an alternate embodiment that is not inflatable, the buoyant body is constructed of a lightweight, buoyant material such as styrofoam or the like. Different volumes of the same shape may be constructed to accommodate people of different sizes such as men, women, and children.

It is an object of this invention to provide an aid for exercising in a body of water which allows a person to remain in a substantially seated, upright position while exercising the legs, arms, and torso without totally submerging the body of the exerciser in the water.

It is another object of the invention to provide an exercising device which may be adjusted to a neutral buoyancy, positive stable position to allow one to remain in a seated upright position in a body of water with the upper torso of the user being suspended above the surface of the water and which remains so even during movement of the legs or arms of the user.

And yet, still another object of this invention is to provide a recreational therapeutic or athletic device that may be utilized in a swimming pool or other suitable swimming area which allows one to exercise freely without becoming completely submerged during exercising.

But yet still another object of this invention is to provide a device which may include a paddle wheel or propulsion means which allows the user to transport himself in a body of water without becoming totally submerged in the body of water.

PREFERRED EMBODIMENT OF THE INVENTION

Figure 1:
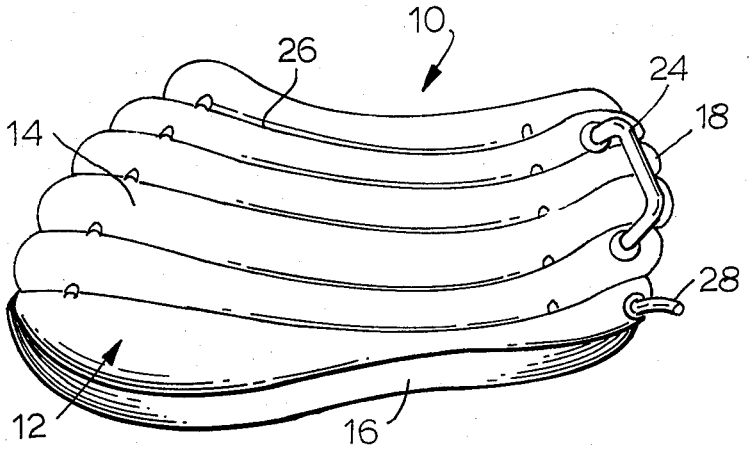
FIG. 1 shows a perspective view of the instant invention.

Referring now to the drawings and specifically FIG. 1, one embodiment of the present invention is shown generally at 10 comprised of a flexible, hollow, inflatable body 12 having an enlarged rear portion 14, a laterally recessed central portion 16 and a forward end portion 18. The central portion 16 is straddled by the user when seated, with the greater volume of the body 12 disposed in the rear area 14 compared with the forward portion 18. The body 12 is made of a resilient, thermoplastic material that is sealed about and formed substantially in the shape as shown. A plurality of chambers separated by ribs 26 may be utilized for more longitudinal structural rigidity of the device when inflated which are interconnected by apertures through ribs 26. A valve 28 for receiving air is disposed near the front end 18.

A handle 24 is disposed at the forward end of the body which may be grasped by one or both hands of the user to hold onto the body during exercising.

Figure 2:
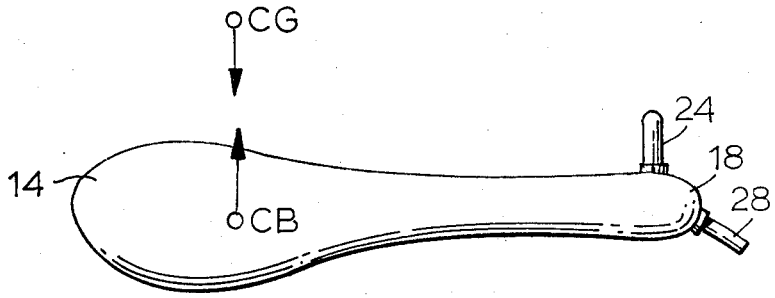
FIG. 2 shows a schematic diagram showing the forces involved in the present invention.

Referring now to FIG. 2, a volumetric schematic diagram is shown which shows that the rear portion of the body has a substantially larger volume which positions the center of buoyancy to the rear of the longitudinal axis of the body. This allows for more substantial alignment between the center of gravity of the user and the center of buoyancy of the body for stability.

Figure 3:
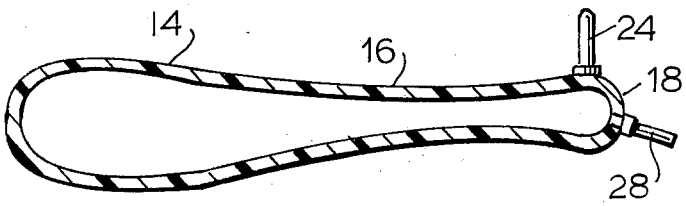
FIG. 3 shows a side elevational view in cross-section of the inflatable embodiment of the present invention.

FIG. 3 shows the tapered vertical thickness which allows for resiliency in conforming to the shape of an individual seated on the device without reducing overall longitudinal support.

Figure 4:
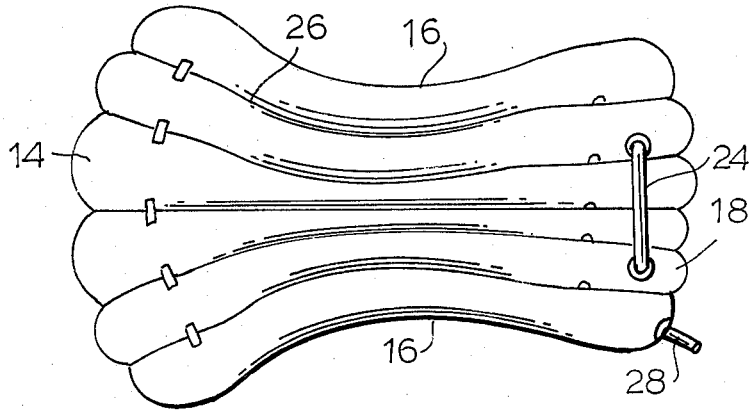
FIG. 4 shows a top plan view of the instant invention.

FIG. 4 shows the lateral recessed central areas 16 which allow one to comfortably straddle the device in a seated, upright position.

Figure 5:
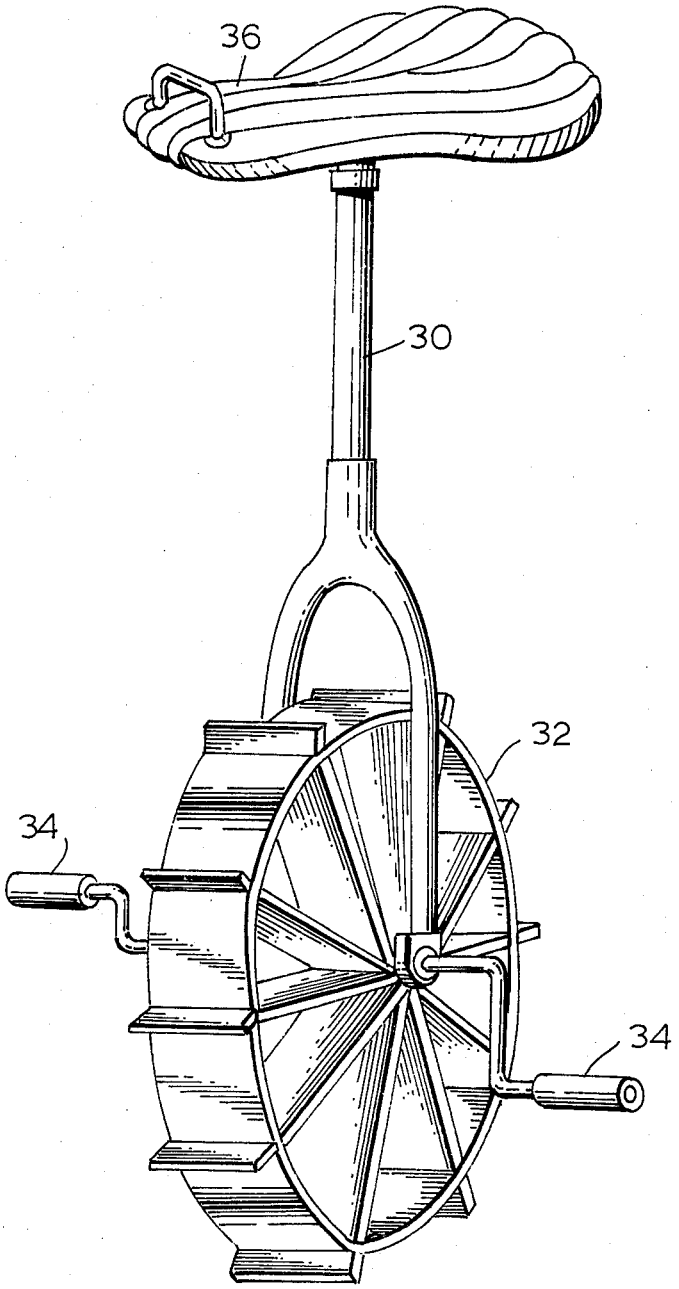
FIG. 5 shows a perspective view of an alternate embodiment of the instant invention.

In another embodiment of the invention, (FIG. 5), affixed to the lower portion of the buoyant body is a shaft 30 that is somewhat extendable in length and includes a paddle wheel 32 and a pair of pedals 34 which are engaged by the feet of the user. The paddle structure 32 may include an adjustable friction increasing member to increase or decrease the amount of force necessary to rotate the paddle. The vertical shaft 30 may be telescopic or stretchable to allow for adjustment depending on the size of the person using the device. The paddle 32 may provide for transportation in the water or may be used to exercise in place for additional strenuous exercise of the legs. The buoyant body is useful for increasing the buoyancy of the device in conjunction with the paddle wheel 32 affixed thereto with the additional buoyancy being provided by the amount of air received into the hollow body itself. The paddles also inpart a turbulence to the water that creates a whirlpool effect for additional muscle stimulation.

The device may be mounted or de-mounted by positioning the buoyant body by hand between the legs of the user. When mounted, the user is free to move legs and arms while the chest and upper torso are above the water surface.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An aid for exercising in a body of water to allow one to exercise in a seated upright position while sustaining the upper torso and head of the user out of the water, comprising:

a one piece flexible inflatable buoyant body having a valve for inflation, said body having an enlarged (in volume) rear portion, a central, laterally recessed portion on each side for receiving the legs of a person straddling the body, and a forward portion having a reduced volume compared to the rear portion, the center of buoyancy being disposed behind the recessed areas toward the enlarged rear portion of the body, a handle connected to the forward upper surface of said body, a vertical shaft extending downward from the central portion of the bottom of the body and having an inverted Y on the bottom of said shaft, pedals on the lower extremities of the inverted Y, and a paddle wheel supported within the inverted Y and connected to the pedals.

* * * * *